United States Patent [19]

Weiss

[11] Patent Number: 4,796,804

[45] Date of Patent: Jan. 10, 1989

[54] POP-UP SPRINKLER WITH IMPROVED INLET VALVE

[76] Inventor: Ilan Weiss, 11 Ralph Avenue, Copiague, N.Y. 11726

[21] Appl. No.: 89,566

[22] Filed: Aug. 26, 1987

[51] Int. Cl.[4] ..... B05B 15/10

[52] U.S. Cl. ..... 239/1; 239/203; 239/205; 239/576; 239/586; 251/5

[58] Field of Search ..... 239/203–206, 239/569, 576, 586, 1; 251/5

[56] References Cited

U.S. PATENT DOCUMENTS

| | | | |
|---|---|---|---|
| 2,622,620 | 12/1952 | Annin | 251/5 |
| 3,145,967 | 8/1964 | Gardner | 251/5 |
| 3,239,100 | 3/1966 | Peterson | 251/5 X |
| 3,325,138 | 6/1967 | Connolly | 251/5 |
| 3,354,970 | 11/1967 | Lummus | 251/5 X |
| 3,713,584 | 1/1973 | Hunter | 239/206 |
| 4,432,495 | 2/1984 | Bruninga | 239/205 |

OTHER PUBLICATIONS

Inbal Control Valves brochure, 11/86.

*Primary Examiner*—Andres Kashnikow
*Assistant Examiner*—Mary Beth O. Jones
*Attorney, Agent, or Firm*—Myron Amer

[57] ABSTRACT

A pop up sprinkler utilizes a diaphragm valve oriented in a vertical manner within the sprinkler water inlet. The valve has a circular bellows surrounding a core and is movable between an expanded position embracing the core and a relaxed position displaced from the core. In the displaced position water flow through the sprinkler is allowed, such flow passing about the core in a manner which creates minimal pressure loss in the valve.

3 Claims, 2 Drawing Sheets

POP-UP SPRINKLER WITH IMPROVED INLET VALVE

The present invention relates generally to a "pop-up" type sprinkler of the type used to irregate a golf course or the like, and more particularly to improvements in the construction and operation of such a sprinkler due to use of an improved and better performing inlet valve for the sprinkler.

PRIOR ART

The most popular sprinkler of this character is that with a "pop-up" operational mode, in which the sprinkler head during non-use is at ground level, and when placed in use, the sprinkler head raises or "pops-up" to an above ground position for spraying and irregating a golf course or the like. These two positions avoid conflict of the sprinkler head with pedestrians and moving equipment.

EXAMPLES OF PRIOR ART

U.S. Pat. No. 4,432,495 to Bruninga describes a typical pop-up sprinkler that advantageously can be used to irrigate a golf course in which, in conjunction with the pop-up operation as described, also typically has a check valve at its inlet connection to the water supply to prevent, during non-use, any backflow of surface water through the sprinkler into the water supply which might contaminate the water supply. Flow control with a check valve however, is at the expense of a significant pressure loss which, in turn, restricts the area that is irrigated by the exiting water.

U.S. Pat. No. 3,145,967 issued to Gardner discloses a valve using an elastic sleeve, and is noted because unlike a check valve, the opening or withdrawal of the elastic sleeve from a centrally located sealing member or core in the flow passage of the valve, does not give rise to a significant pressure drop in the water flowing therethrough. However, neither in Gardner or any other known patent, or in any manufacturers' literature concerned with this type of valve, is it suggested that it be used as an inlet to a pop-up sprinkler. Moreover, the valve as disclosed in Gardner and the prior art is horizontally oriented with respect to the direction of water flow, and thus the valve and the opening and closing directions of movement of the elastic sleeve thereof are not applicable, as disclosed, for use in a pop-up sprinkler.

It is desirable to provide a pop-up sprinkler for golf course irrigation which is operable with the pop-up feature and also includes means to prevent water supply contamination, but in which the prior art shortcoming of significant water pressure loss is overcome. More particularly, the typical pop-up sprinkler sold in the United States has a 20 to 23% pressure loss, depending on the manufacturer. The inventive unit is tested to have no more than 2 to 3% pressure loss.

The typical pop-up sprinker currently on the market, using the same nozzle size outlet as the inventive unit, will cover up to a 180 foot diameter at 85 psi whereas, under most conditions, the inventive unit will cover up to a 210 foot diameter.

Stated somewhat differently, when a typical 18 hole golf course is to be irrigated by the sprinklers of the classification herein described, 540 appropriately spaced prior art sprinklers are required, whereas for the same area, only 440 sprinkler valves are required when constructed in accordance with the present invention.

The present invention performs with the significant advantages noted due to the substitution for the check valve of the pop-up sprinkler of an elastic sleeve or bellows-type valve, heretofore never used in combination or suggested for combination with the pop-up sprinkler. Underlying the invention is the recognition that in the operation of the bellows valve, that the water is in a holding chamber downstream of the sealing core and that upon the opening or lateral withdrawal of the bellows from the sealing core, the water has almost a straight line path past opposite sides of the sealing core, having already been divided in the holding chamber into two streams with respect to the sealing core. This straight line path avoids changes in direction which, as is well known, results in pressure loss.

The description of the invention which follows, together with the accompanying drawings should not be construed as limiting the invention to the example shown and described, because those skilled in the art to which this invention appertains will be able to devise other forms thereof within the ambit of the appended claims.

FIG. 2 is a sectional detail of the sprinkler inlet immediately after being turned on;

It is already well known that there is an extensive classification of sprinklers whose purpose is to efficiently deliver water to lawns, golf greens, farm plants and the like. Of concern in this invention is the type sprinkler that is mounted at or slightly below ground surface. The sprinkler can be of the fixed head full circle (or part thereof) type, or any of the many that have "pop-up" heads with self-indexing or otherwise.

In the type sprinkler that is "ground mounted", it is required that the sprinkler inlet have a check valve to prevent backflow of contaminated surface water into the water supply system. Surface water may contain insecticides, fertilizers and the like and may therefore befoul the municipal or local well water supply. The check valve can be of the flapper gravity type, or of the spring-biased plunger type.

Figure 2:
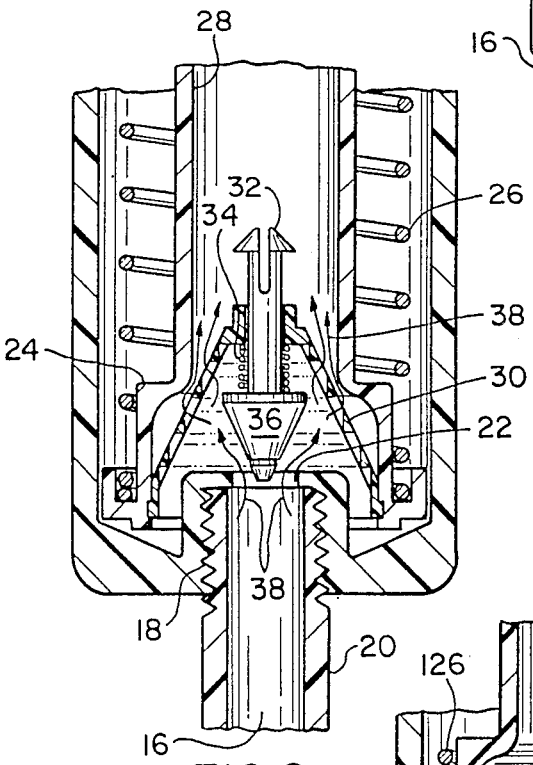
FIG.2 PRIOR ART
Figure 3:
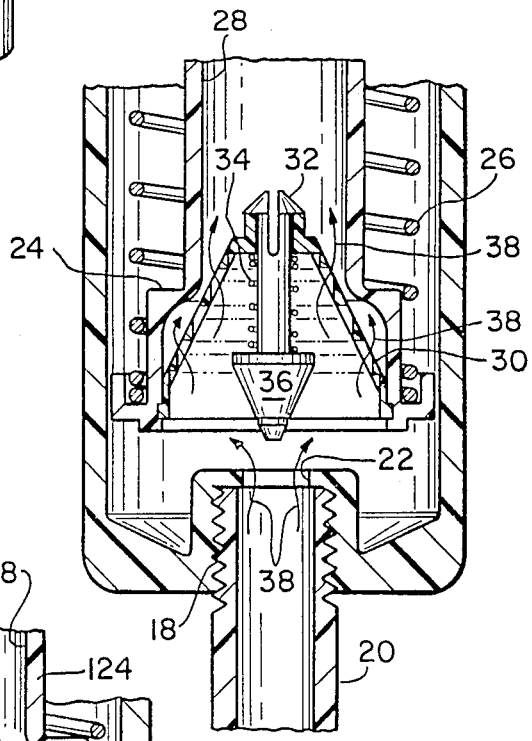
FIG.3 PRIOR ART
FIG. 3 is a view similar to FIG. 2 but demonstrating the operation of a "pop-up" lift piston of the FIG. 2 sprinkler.

As a specific example of the prior art, FIGS. 2 and 3 show a plunger type check valve as used in U.S. Pat. No. 4,432,495 issued to Kenneth J. Bruninga. Only the sprinkler inlet portion is detailed, as many different "head" constructions may be used.

Figure 1:
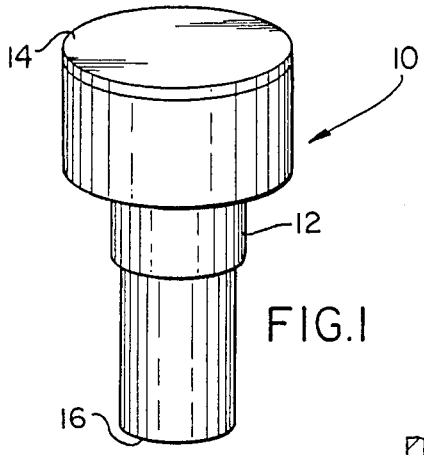
FIG. 1 is an overall perspective view of a ground-level sprinkler.

In FIG. 1, a typical sprinkler 10, such as that of the Bruninga patent, is shown in which a housing 12 contains a head portion 14 and an inlet connection 16.

In FIG. 2, it is shown that housing 12 supports a threaded section 18 to which water supply pipe 20 is connected. Immediately above the connection is a valve seat 22. Within housing 12 there is a "pop-up" piston 24 which supports the head portion (not shown) of the sprinkler. Spring 26 biases piston 24 in a retracted position to avoid conflict of the sprinkler head with pedestrians and moving equipment.

Within piston 24 is a flow passage or conduit 28 which permits passage of water to the sprinkler head. Within passage 28 is a strainer-support 30. Mounted therein is a spring 34 and a spring-biased plunger 32. Plunger 32 is supplied with a rubber washer 36. When there is no line pressure in the supply pipe 20, piston 24 is fully retracted and washer 36 seats on valve seat 22, thus preventing any possibility of ground surface water backflowing into supply pipe 20.

The condition in FIG. 2 is only in which water flow has just been initiated and washer 36 has just lifted off seat 22 compressing spring 34. Shortly thereafter, as shown in FIG. 3, and as pressure builds within housing 12, piston 24 rises compressing spring 26 to lift the head mechanism 14 above ground. At this time, washer 36 is in the down position relative to piston 44, but cannot seat on valve seat 22 because piston 24 has been raised into its "pop-up" condition. On both FIGS. 2 and 3, a set of arrows 38 have been superimposed indicating the tortuous route the sprinkler water must travel to find its way through the inlet 16. As is well known, and as should be noted at this point in the description, each change in water direction within a hydraulic system results in a pressure drop and hydrodynamic inefficiency. It is this inefficiency which the within inventive valve of FIG. 4 obviates.

Figure 4:
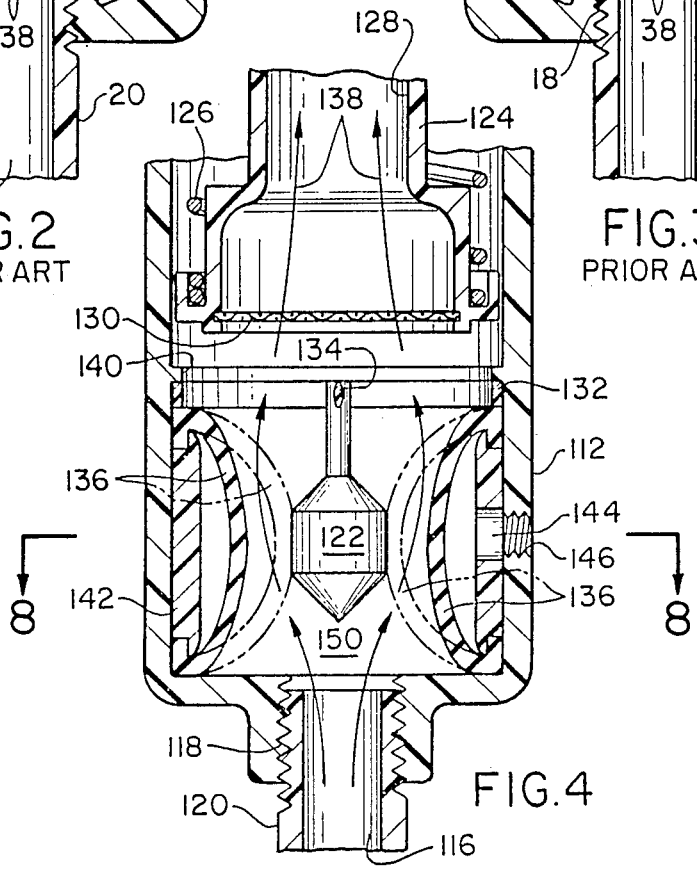
FIG. 4 is a view similar to FIGS. 2 and 3, but of the inventive sprinkler.

FIG. 4 is a view similar to FIGS. 2 and 3 in which sprinkler 110 employs a lowflow resistance, backflow prevention device, which is the crux of the invention. Housing 112 provides for a head portion (not shown) and an inlet connection 116.

Adjacent threaded section 118 and supply pipe 120, a core cylinder 122 is co-axially suspended from a support ring 132 which has a minimum number of streamline spokes 134 (in this instance, since a plan view has been omitted as unnecessary, it being understood that the circumferencially spaced spokes 134 are four in number). A step-shoulder 140 within housing 112 holds the support ring 132 as well as a flexible cylindrical bellows member 136 in place. The general nature and operation of the referred to bellows-type valve is detailed in the manufacturer's literature, and may be such as described in the November, 1986 brochure entitled "Inbal Control Valves" illustrating and describing a said bellows-type valve as produced by Inbal, of 103 East Kenowick Avenue, Kenowick, Wash. 99336. The within bellows in the literature is referred to as a "resiliant sleeve". Also, in the literature just referred to, none of the "typical applications" set forth therein is in connection with a pop-up sprinkler, nor is the valve illustrated in a vertical orientation; rather, the valve is illustrated in the literature in a horizontal orientation, and therefore, in these two respects, namely as to application and orientation, the literature referred to differs significantly from the description herein provided of the inventive valve of FIG. 4.

Returning again to the description of the inventive valve of FIG. 4, it will be noted that within the bellows is a support sleeve 142. Sleeve 142 has at least one opening 144 which aligns with threaded connection 146 in housing wall 112. Bellows 136, which is made of rubber, is molded in a well understood manner, and as explained in the literature referred to, so as to be in a configuration providing a normally closed position. That is, with no line pressure at inlet 116 or at connection 146, the bellows or resilient sleeve 136 will make contact against the core 122, thereby effectively stopping backflow through the sprinkler. Similarly, when there is equal pressure at inlet 116 and connection 146, no flow can take place. However, as will later be explained, when control pressure at connection 146 is reduced and line pressure is maintained at inlet 116, there is movement of the bellows 136 away from the core 122, and this in what should be a readily understood manner thereby initiates the commencement of, and permits the flow through the sprinkler.

At the point in the operation depicted in FIG. 4, there is therefore water flow through the strainer 130, conduit 128 and out of the sprinkler head 14 (FIG. 1). Due to resistance through the sprinklerhead 14, pressure develops behind piston 124 which lifts head 14 above ground, compressing spring 126 and further enlarging the clearance which exists between the vented, relaxed bellows or resilient sleeve 136 and the central core or sealing disk 122. Arrows 138 show the path of the smooth, almost straight line flow through the inlet 116.

At this point in the description, it is helpful to note the significant differences in the flow pattern through the prior art valve of FIGS. 1, 2 and the inventive valve of FIG. 4. Superficially it may appear that the check valve 36 of the prior art valve and the core 122 of the inventive valve both occupy an obstructing position in the required vertically oriented flow pattern of these valves. This, however, is not the case. In the prior art valve the check valve 36 lifts from the valve inlet 22 and thus, of necessity, must block the flow through the inlet. In sharp contrast to this, in the inventive valve of FIG. 4, the water below the core 122 already is divided on opposite sides of this component, filling a lower inlet chamber 150, a holding chamber which it reaches after flowing through the inlet 116. Thus, the inlet 116 and the prior art inlet 16 are perhaps equivalent, but in the inventive valve, there is an additional holding chamber 150, relative to the centrally located core or sealing disk 122. As a result, when the resilient sleeve or bellows 136 withdraws laterally away from the core 122, the water from the holding chamber 150 which, with respect to the core 122, is already on opposite sides thereof, flows through the clearance provided by the laterally withdrawing bellows and thus, as illustrated by the arrows 138 in FIG. 4, follows an almost straight line path through the outlet of the sprinkler mechanism 14, which it will be understood is a part of the inventive valve of FIG. 4.

What has just been described in connection with the straight line path of water flow through the inventive valve of FIG. 4 is in sharp contrast to the tortuous path followed through the prior art valve of FIGS. 2, 3 and this difference will thus be understood to constitute the invention over the prior art. As a result of these different flow paths, there is significantly less pressure drop in the water provided by the inventive valve of FIG. 4 than in the water exiting from the prior art valve of FIGS. 2, 3. Thus, when used as an irrigating device on a golf course, the higher pressure in the water exiting from the valve of FIG. 4 results in its covering a greater area.

EXEMPLARY CONTROLS

Figure 5:
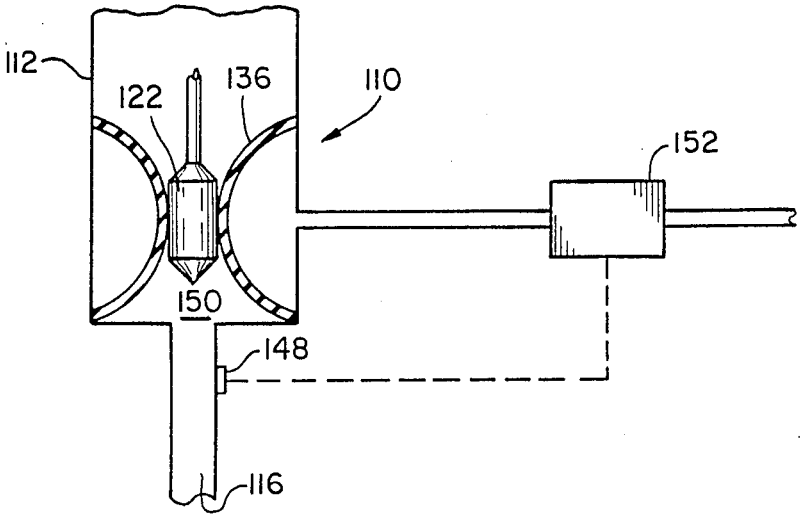
FIGS. 5, 6 and 7 are each schematic diagrams showing different embodiments of controls for the inventive sprinkler of FIG. 4.
Figure 6:
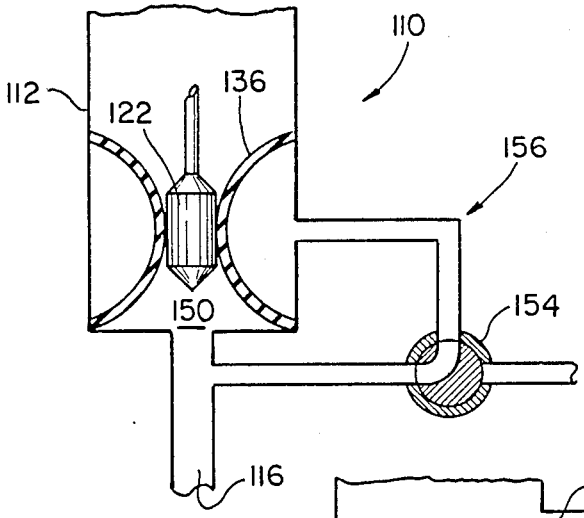
Figure 8:
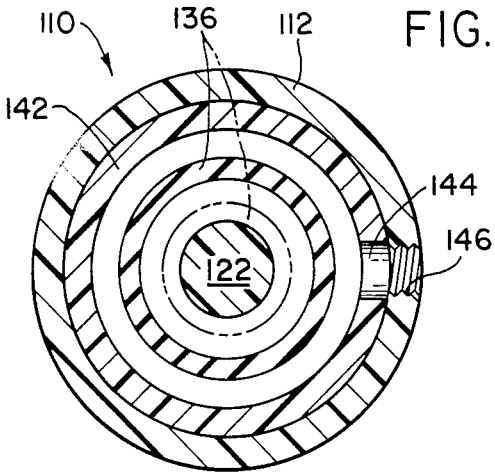
FIG. 8 is a transverse sectional view taken along line 8—8 of FIG. 4.
Figure 7:
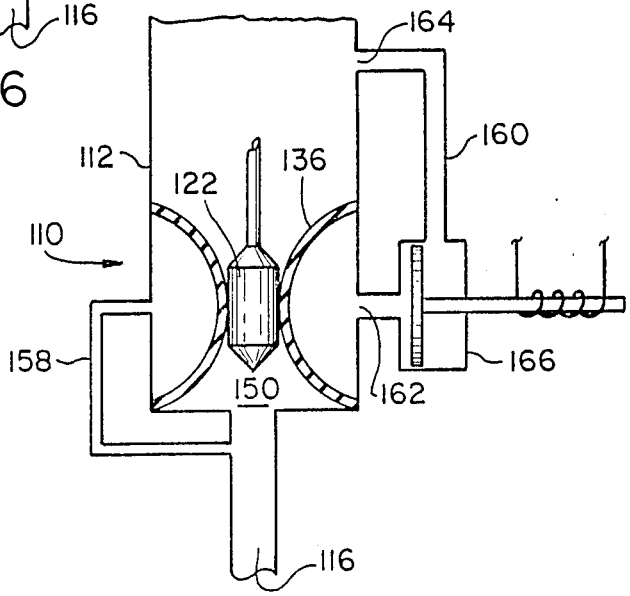

In the schematics of FIG. 5, 6 and 7 are shown various sprinkler inlet control systems. These are shown for completeness' sake only, since it is the construction and operational mode of the inlet valve that is the invention, and not any particular control system that is applied thereto.

FIG. 5 shows a sprinkler 110 where pressure at inlet connection 116 might become negative due to pump failure. This might occur on an elevated golf tee for instance. Sensing means 148 detects pressure failure and signals auxiliary water supply 152 to build up pressure and close bellow 136 against core 122. When supply pressure is restored, sensing means 148 signals auxiliary supply 152 to turn off and vent, allowing flow through inlet 116.

FIG. 6 shows a sidearm construction of sprinkler 110 where line pressure can be maintained on the bellows 136. Due to its normally closed as molded configuration, bellows 136 prevents any flow through inlet 116. A rotary plug valve 154 in sidearm 156, when rotated 90 degrees clockwise, cuts off line pressure from the bellows 116 while allowing the bellows to vent, thus allowing flow through inlet 116. Valve 154 and sidearm 156 may be activated in any number of ways, such as manually, mechanically, or electrically, and may be integral with the sprinkler body or remote from it.

FIG. 7 shows still another control arrangement. A first sidearm 158, with a small bore, allows supply pressure to fill the bellows 136 and hold it against core cylinder 122. A second sidearm 160 is connected at connection 162 at its lower end. Its upper end is connected to housing 112 at point 164 or to atmosphere. Between the ends is a valve 166, shown herein as a solonoid but which also could be manual or mechanical, which is shut when no flow through the sprinkler is wanted. To permit operation of the sprinkler, valve 166 is opened and pressure decreased within the bellows 116. The bellows thereupon withdraws allowing the clearance between it and the core 122 to enlarge and thus flow commences through the sprinkler valve, all in a manner as has already been described.

While the particular sprinkler valve and operational mode herein shown and disclosed in detail in particular reference to FIG. 4 is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed:

1. A pop-up irrigation sprinkler having a below surface inlet and a diaphragm valve operatively disposed in a vertical orientation in said inlet, said diaphragm valve being of the type having a sealing core and a cylindrical belows in encircling relation thereabout operatively effective to be urged in opposite directions between a clearance position spaced from said sealing core and a contact position therewith for opening and closing said inlet, whereby said bellows movement opening said inlet is not in opposition to the directional flow therethrough and contributes to minimal pressure loss in said flow.

2. A pop-up irrigation sprinkler as claimed in claim 1 wherein said bellows defines a flow passage with said sealing core located centrally therein and a water holding chamber formed upstream of said sealing core by said bellows when in sealing engagement against said sealing core, whereby upon lateral contraction of said bellows away from said sealing core said water from said water holding chamber flows in substantially straight line paths about said sealing core with minimal pressure loss in said water.

3. A method of irrigating a golf course or the like using a sprinkler having a bellows inlet valve comprising the steps of normally closing a vertically oriented bellows against a centrally located sealing core of said valve so as to bound a holding chamber for water upstream of said sealing core and bellows, filling said holding chamber with water, and releasing said water for vertical flow through said sprinkler by laterally contracting said bellows from said normally closed position against said sealing core, whereby said water flows in substantially straight paths past said sealing core through said sprinkler.

* * * * *